US007299922B2

(12) United States Patent
Ceballos

(10) Patent No.: US 7,299,922 B2
(45) Date of Patent: Nov. 27, 2007

(54) DECORATIVE DENTIFRICE HOLDER

(75) Inventor: Tamara Ceballos, Lake Worth, FL (US)

(73) Assignee: Tamera Cleary, Lexington, NC (US)

( * ) Notice: Subject to any disclaimer, the term of this patent is extended or adjusted under 35 U.S.C. 154(b) by 408 days.

(21) Appl. No.: 11/165,596

(22) Filed: Jun. 22, 2005

(65) Prior Publication Data

US 2006/0000729 A1 Jan. 5, 2006

Related U.S. Application Data

(63) Continuation-in-part of application No. 10/720,305, filed on Nov. 24, 2003, now abandoned.

(60) Provisional application No. 60/506,086, filed on Sep. 25, 2003.

(51) Int. Cl.
*B65D 83/10* (2006.01)

(52) U.S. Cl. ..... 206/362.1; 206/362; 206/15.2; 211/65

(58) Field of Classification Search ..... 206/361, 206/362, 362.1, 362.3, 15.2, 15.3; 248/110; 211/65, 119.009; 312/206, 207; D6/528, D6/530, 531, 534, 535; 220/736, 740
See application file for complete search history.

(56) References Cited

U.S. PATENT DOCUMENTS 1,507,466 A * 9/1924 Collins ..... 206/209.1
1,975,691 A 10/1934 Hibbs
2,950,946 A * 8/1960 Starworth ..... 312/207
D231,593 S * 5/1974 Ockerman ..... D6/531
4,219,035 A 8/1980 Deconiack
D278,778 S 5/1985 Brown
4,978,003 A * 12/1990 Foster ..... 206/217
4,995,511 A * 2/1991 Evans ..... 206/362.1
5,484,065 A * 1/1996 Davoli et al. ..... 211/65
5,522,497 A 6/1996 Stacy
5,769,245 A 6/1998 Butler
D413,033 S 8/1999 Harris
D417,352 S * 12/1999 Hampshire ..... D6/527
6,116,434 A 9/2000 Park
6,186,324 B1 * 2/2001 Catterson ..... 206/362.1
D439,781 S * 4/2001 Spore ..... D6/534
6,253,931 B1 7/2001 Starkey
6,635,332 B1 * 10/2003 McArthur ..... 428/132
6,935,515 B1 8/2005 Sookoo

* cited by examiner

*Primary Examiner*—David T. Fidei

(57) ABSTRACT

The present invention is directed towards a dentifrice item holder; most particularly a holder capable of holding toothbrushes, toothpaste tubes and other various items, such as a rinse container, mouthwash, dental floss, toothpicks, and the like, all together.

19 Claims, 7 Drawing Sheets

DECORATIVE DENTIFRICE HOLDER

CROSS REFERENCE TO RELATED APPLICATION

This application is a continuation-in-part of patent application Ser. No. 10/720,305, filed Nov. 24, 2003 now abandoned, which is based upon provisional patent application No. 60/506,086 filed Sep. 25, 2003, the contents of which are herein incorporated by reference in their entirety.

FIELD OF THE INVENTION

The present invention is directed towards the field of personal hygiene; particularly towards a dentifrice item holder; most particularly a holder capable of holding toothbrushes, toothpaste tubes and other items, such as a rinse container, mouthwash, dental floss, toothpicks, and the like, all together in one holder.

BACKGROUND OF THE INVENTION

There have long been bathroom fixtures in the form of supporting panels that extend horizontally from a bathroom wall having apertures therein for retaining toothbrushes and/or rinse containers between uses. The lower ends of toothbrush handles are inserted into their respective toothbrush holes until the bristles abut the supporting panel's upper surface, such that the brush hangs from the panel and air dries.

A problem with most conventional support panel toothbrush holders has been that they make no provision for retaining a toothpaste tube and other dentifrice related items, i.e. rinse container, together with at least one toothbrush. An additional problem with such supporting panels is that they are often permanently attached to a bathroom wall, hence, not portable.

In response, various combination toothbrush and toothpaste holders have been proposed, however, none of known prior art provides a combination holder able to simultaneously support a toothbrush, toothpaste and rinse container holder that is easily cleaned and requires no additional parts, such as a hinge or the like.

For example, U.S. Pat. No. 5,522,497 to Stacy discloses a combined toothpaste holder and vented toothbrush container comprising a semi-cylindrical body, a flared base member, a hingedly engaged top and an insert which creates nested channels within the body. An inner channel includes a downward depending flange and engages a toothpaste tube while an outer channel is created within which toothbrush handles depend, the heads being held by the insert and the handles extending into opening. Unlike the instant invention, this combined toothpaste holder and vented toothbrush container is not designed to support and/or house a rinse container therein. Moreover, the design does not lend itself to easy cleaning as it comprises at least four different members that need to be disassembled to ensure through cleaning.

U.S. Pat. No. 4,219,035 to Deconinck discloses a device for holding a mouth-rinsing glass, toothbrushes and a tube of dentifrice comprising a molded synthetic resin body provided with two upwardly open mutually adjacent receptacles, one of which is dimensioned to receive a glass or cup while the other requires a tubular insert be provided with at least two laterally extending ribs to subdivide the second receptacle into a plurality of compartments, each of which can receive the handle of a toothbrush. A tube of dentifrice can be inserted into the center of the insert. Again, unlike the present invention this design requires an additional part, i.e. an "insert", with crevices and ligatures that can be difficult to sanitize effectively.

U.S. Pat. No. 1,975,691 to Hibbs discloses a projecting support panel for holding a combined toothbrush and tumbler holder. The holder having a series of independent holes intended to receive a toothbrush and/or tube of toothpaste vertically therein. The tumbler rests on the collar of the holder body. Unlike the present invention, this configuration requires a tumbler with a specific diameter that corresponds to the diameter of the holder body collar. This presents a problem should the tumbler become lost or damaged, thereby rendering the assembly ineffective for its intended use. In addition, the independent holes provide no means to air dry or drain any of the fluid collected therein making the holder body difficult to clean, thus, prone to microorganism growth.

While the foregoing described prior art device may have advanced the art in a variety of ways, there nevertheless remains a need for an elegant, yet simple, device that is able to support a plurality of different dentifrice related items therein that is portable, economical to manufacture, effortless to assemble and permits access into the interior of the container for easier cleaning.

SUMMARY OF THE INVENTION

Consequently, in response to the aforementioned problems found in the prior art it is the principle objective of the present invention to provide a combination toothbrush and toothpaste tube holder capable of vertically supporting at least one toothbrush and at least one tube of toothpaste therein and which can be adapted to receive additional items therein, such as a rinse container, mouthwash, dental floss, and the like.

It is a further objective of the present invention to provide a holder that is of a stable and durable design, while remaining aesthetically pleasing.

Still another objective of this invention is to disclose one embodiment of a hollow portable holder which is able to store various dentifrice related items therein, (e.g. dental floss, toothpicks or the like), such that these items are all together for easy transport from one location to the next.

Yet still another objective of this invention is to provide a holder designed to permit increased sanitation since the holder has no intricate parts to clean.

A further objective of the instant invention is to provide a holder designed to take up less counter space, that is, can include at least one means for removably attaching to a vertical surface, such as a bathroom wall, or fit into a corner of a bathroom countertop.

An additional objective of the present invention to provide a holder that is economical to manufacture in that it has few components or complicated moving parts.

Other objectives and advantages of this invention will become apparent from the accompanying descriptions taken in conjunction with the accompanying drawings wherein are set forth, by way of illustrations and example, certain embodiments of this invention. The drawings constitute a part of this specification and include exemplary embodiments of the present invention and illustrate various objects and features thereof. It will be readily appreciated by those skilled in the art that the use of a holder for supporting various dental accessories together is highly effective and useful in the personal hygiene art.

DETAILED DESCRIPTION OF THE PREFERRED EMBODIMENTS

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
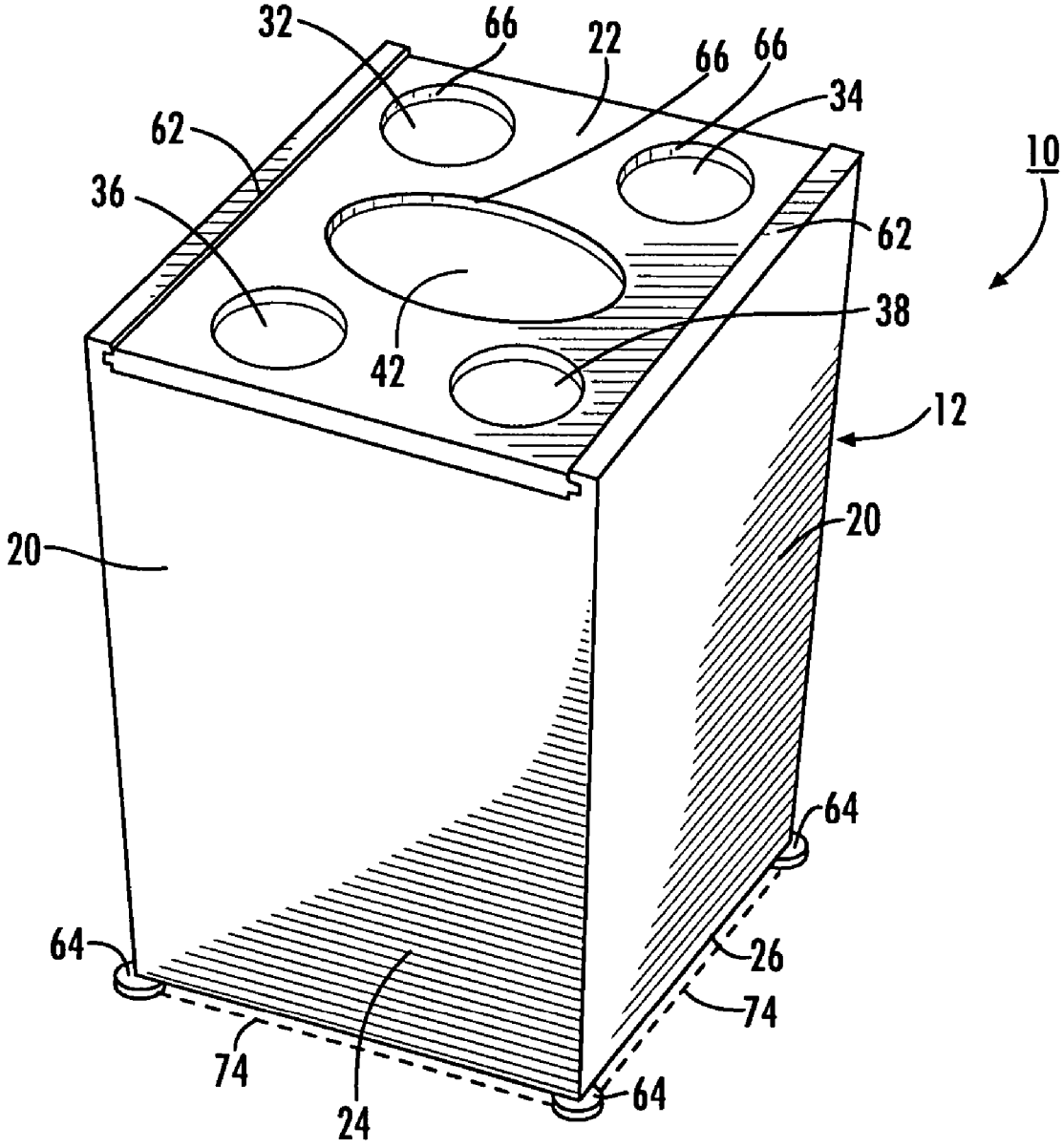
FIG. 1 is an upper perspective view of one embodiment of the instant invention having a square cross-section, as seen along the horizontal axis.
Figure 2:
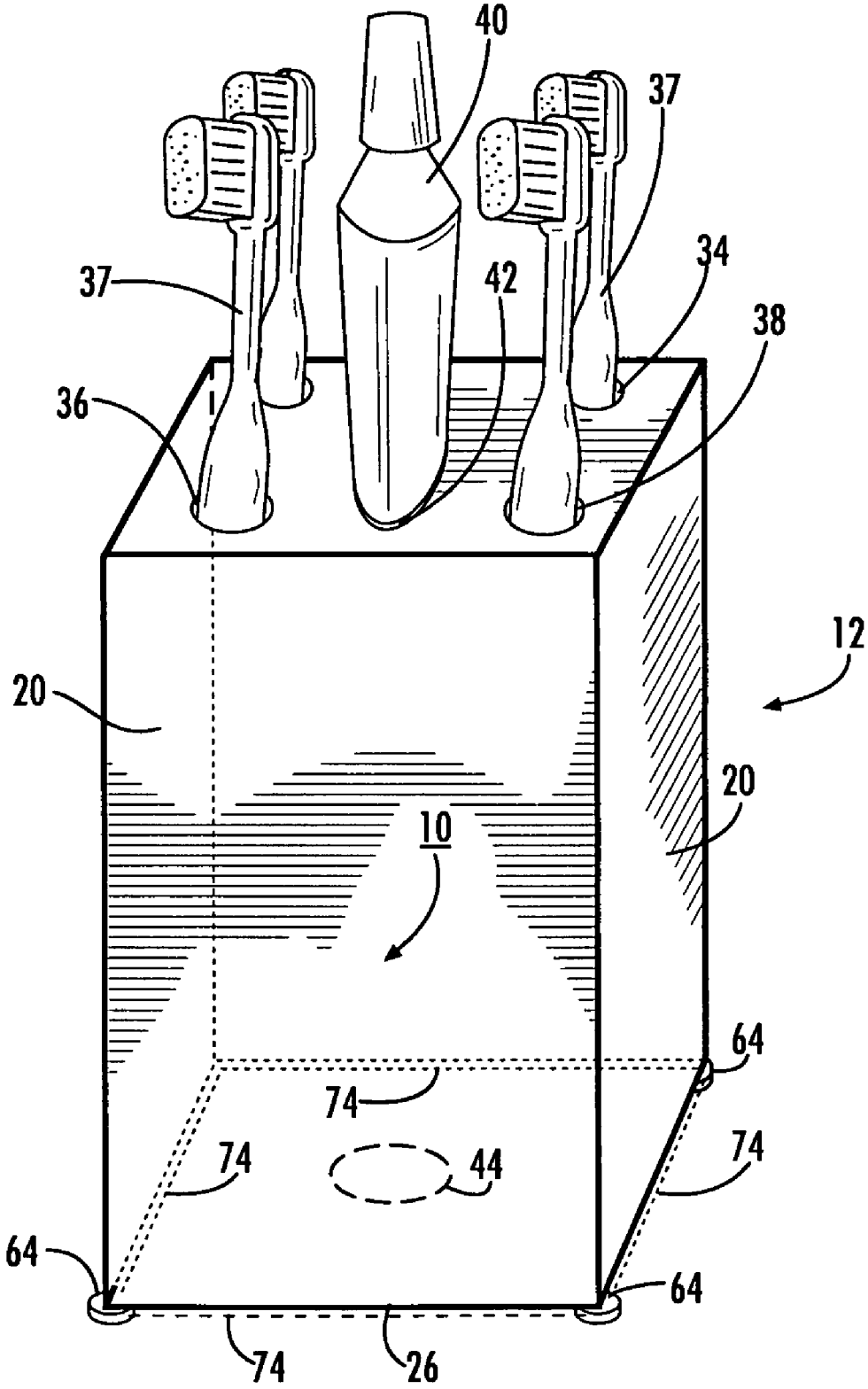
FIG. 2 is an upper perspective view of the holder of FIG. 1, shown with three toothbrushes and a toothpaste tube in their respective ports.

Referring to now to FIGS. 1-7, wherein like elements are numbered consistently throughout, FIG. 1 illustrates one embodiment of a dentifrice container, or holder, generally referenced as 10. Holder 10 includes a body 12 defined by a top panel 22, a bottom panel 26 in spaced apart relation, along a longitudinal axis thereof, sufficient to retain at least one toothpaste tube 40 and at least one toothbrush 37 in a substantially vertical position (FIG. 2). The holder 10 further comprises at least two pairs of opposing sidewalls panels 20, wherein each of the sidewall panels 20 are attached to the bottom panel 26, thereby defining an internal cavity 43 with an upper access opening 45, as shown in FIGS. 3*b*-3*c*.

In addition, the holder 10 of FIG. 1 includes at least one toothbrush receiving ports (or openings) 32, 34, 36, 38 constructed and arranged to receive correspondingly sized toothbrushes 37 and at least one toothpaste tube receiving port 42 also constructed and arranged to receive a correspondingly sized toothpaste tube 40, as shown in FIG. 2. The toothbrush receiving ports 32, 34, 36 and 38 may all have the same, or different dimensions such as progressively increasing diameters capable of receiving toothbrushes 37 of different sizes.

In the embodiments depicted in FIGS. 1-4*c*, the top panel 22 is slidingly attached to at least one of the pair of opposing sidewalls 20. In a particularly preferred configuration, the width of the top panel 22 is slidingly received within a correspondingly sized channel, or groove, 62 such that the top panel 22 can be translated within the channel 62 by the user between a first position, where the top panel substantially covers the upper access opening 45 (FIG. 3*a*) and a second position wherein the top panel 22 provides at least partial access (FIG. 3*b*) or full access (FIG. 3*c*) to the interior cavity 43 of the holder body 12.

Figure 3A:
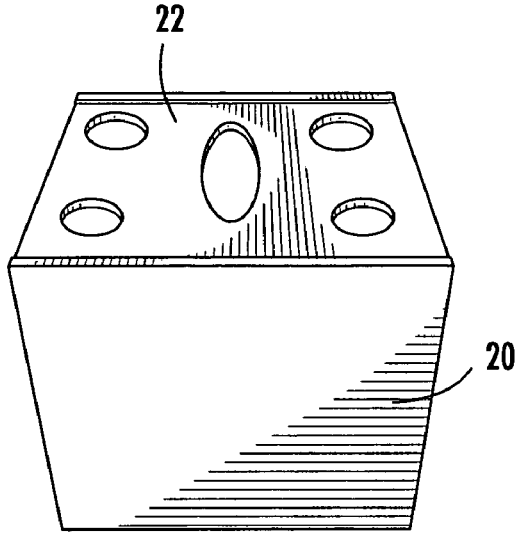
FIG. 3*a* is an upper perspective view of the holder of FIG. 1 having a square cross-section wherein the top panel comprises at least one toothbrush port and toothpaste tube port, the top panel is depicted in a first position where access to the interior of the holder is precluded.
Figure 3B:
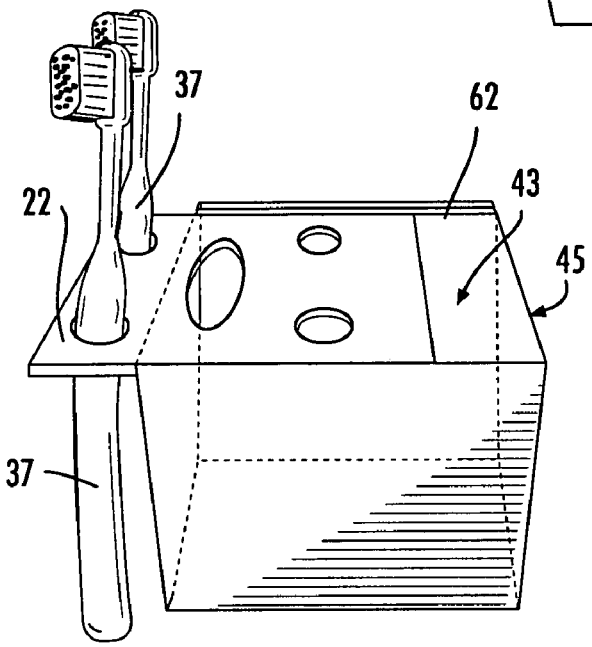
FIG. 3*b* is an upper perspective view of illustrating the holder in FIG. 3*a* in a second position wherein the interior is, at least, partially accessible.
Figure 3C:
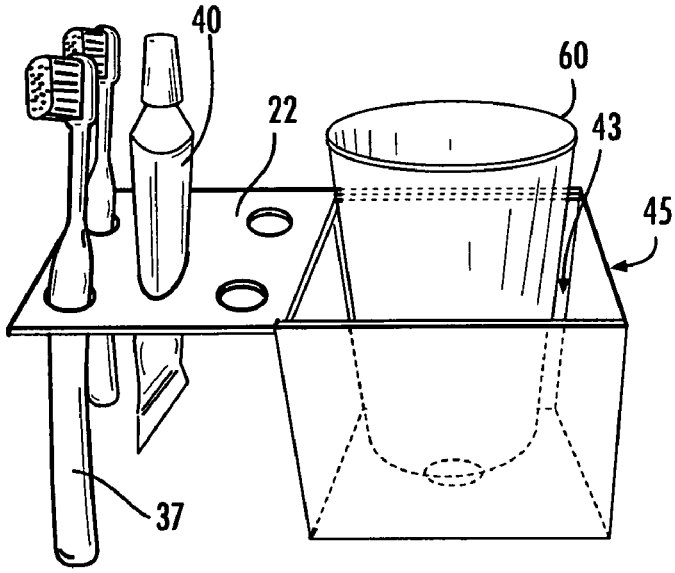
FIG. 3*c* is an upper perspective view of the holder in FIG. 3*a* wherein the interior is in a fully accessible position.

It can be appreciated that when the top panel 22 is positioned to provide at least partial access or full access to the interior cavity 43, the user may be able to place additional items such as, a rinse cup 60 into the interior cavity 43 and at least one toothbrush 37 or toothpaste tube 40 into corresponding ports formed in the top panel 22, as shown in FIGS. 3*b* and 3*c*. This configuration is particularly desirous as it able to simultaneously support at least one toothbrush 37, a rinse container 60 and potentially a toothpaste tube 40 (depending on position of top panel 22 along the channel 62). Moreover, when positioned as shown in FIG. 3*c*, the user can readily clean the interior cavity 43.

Conversely, the outer periphery of the top panel can include a channel (not shown) constructed and arranged to received a projection (not shown) integrally connected to at least one pair of opposing sidewalls, wherein the top panel is readily translated between the first position and the second position along the projection.

Figure 4A:
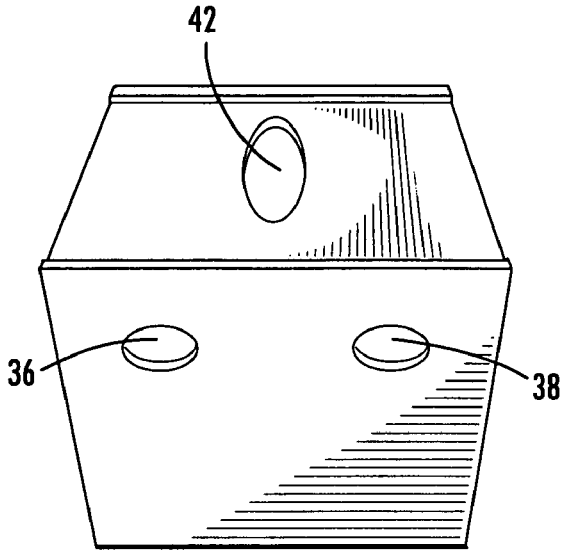
FIG. 4*a* is an upper perspective view of the holder illustrating the sidewall panels comprising at least one toothbrush port and top panel comprising a toothpaste tube port, the top panel is depicted in the first position where access to the interior of the holder is precluded.
Figure 4B:
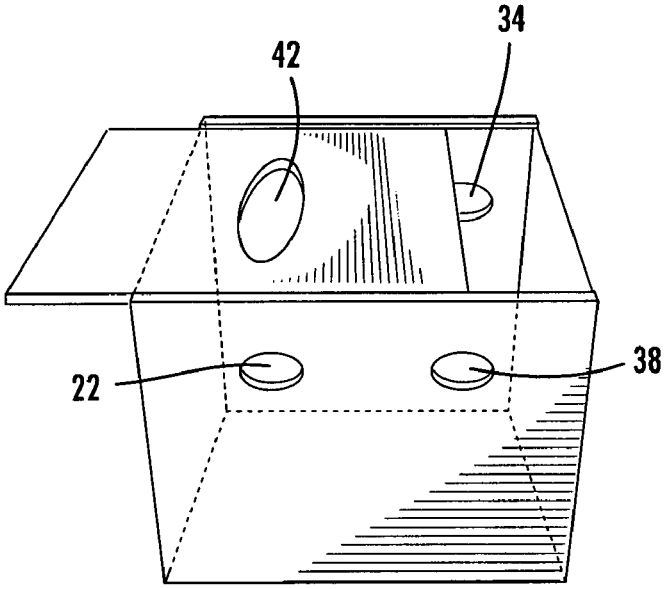
FIG. 4*b* is an upper perspective view of illustrating the holder in FIG. 4*a* in a second position wherein the interior is at least partially accessible.
Figure 4C:
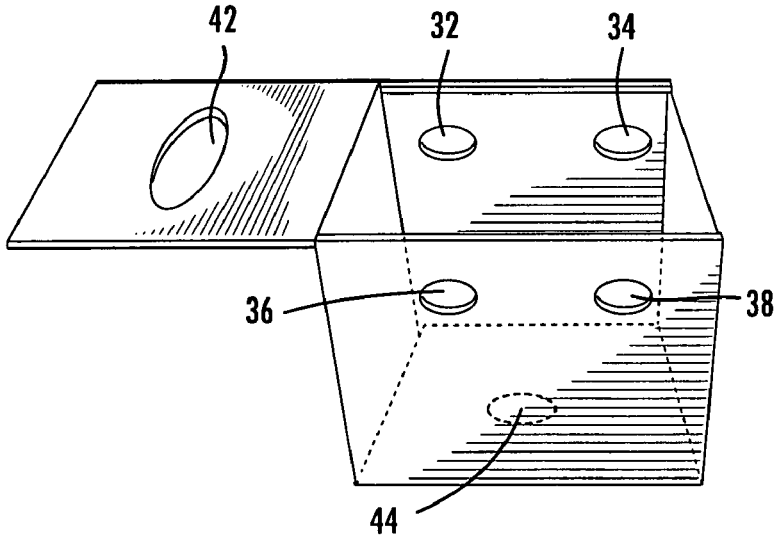
FIG. 4*c* is an upper perspective view of illustrating the holder in FIG. 4*a* in the second position wherein the interior is in a fully accessible position.

As illustrated in FIGS. 1-3*c*, the toothbrush receiving ports 32, 34, 36, 38 and toothpaste tube receiving port 42 are located within the top panel 22, however, it is contemplated herein that these ports can be located within the sidewall panels 20, as shown in FIGS. 4*a*-*c* without departing from the scope of the instant invention. Moreover, although not specifically shown herein, it would be obvious to the skilled artisan to include at least one toothbrush receiving port 32 and one toothpaste tube receiving port 42 in both the top and sidewall panels.

The toothbrush receiving ports 32, 34, 36, 38 are shown herein as circular, however, it would be obvious to one skilled in the art to provide openings of different configurations, e.g., oval, square, rectangular, triangular, etc., without departing from the scope of the instant invention. Similarly, the toothpaste tube receiving port 42 may be provided in any shape known in the art.

In a preferred embodiment, the toothbrush receiving ports 32, 34, 36, 38 and/or toothpaste tube receiving port 42 can include a chamfered edge 66 which either projects downward or upward with respect to the surface of panel 20, 22 and functions to retain the toothbrush or toothpaste tube in a generally vertical position. In one embodiment, the toothbrush receiving ports are sized such that they are wider than the bristle end of a standard toothbrush 37, such that the toothbrushes, and/or toothpaste tube, are supported by their lower ends, which rest on either bottom panel 26, or a support surface (i.e. countertop) when the holder 10 is resting on the support surface.

Figure 5:
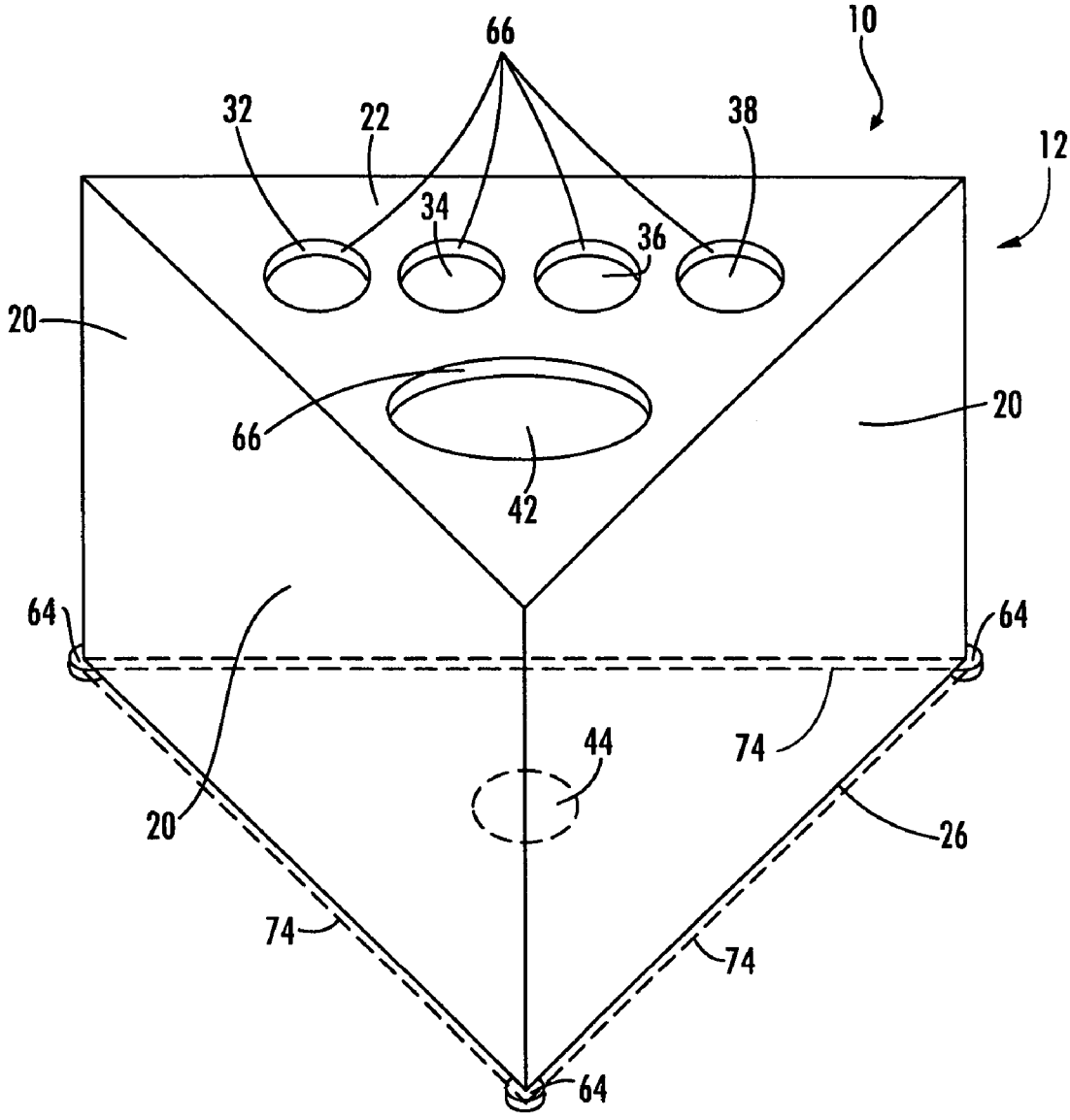
FIG. 5 is an upper perspective view of one embodiment of the instant invention having a triangular cross-section as seen along the horizontal axis, the top panel comprising a plurality of toothbrush receiving ports and one toothpaste tube receiving port.
Figure 6B:
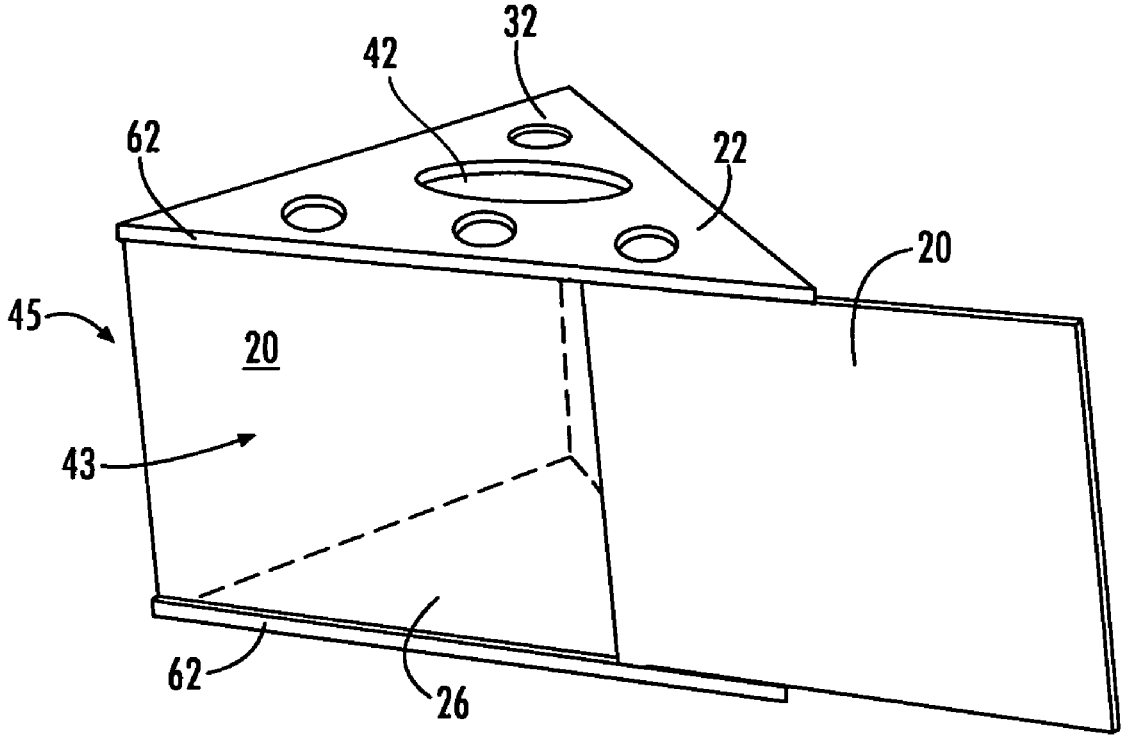
FIG. 6*b* is an upper perspective view of the holder shown in FIG. 5 with a triangular cross-section as seen along the horizontal, with the top panel depicted in a first position where admittance to the interior of the holder is accessible.

In the aforementioned embodiments shown in FIGS. 1-4*c*, the holder body 12 is shown with generally rectangular cross-section, as seen along the transverse of the longitudinal axis. However, it would be obvious, to provide a holder body with a horizontal cross-section in another desired shape. For instance, FIGS. 5-6*b* illustrate a holder 10 with a generally triangular horizontal cross-section, as seen along the horizontal axis. Like the previous embodiments, the configuration depicted in FIGS. 5-6*b* illustrate a body 12 defined by a top panel 22 and a bottom panel 26, in spaced apart relation along a longitudinal axis thereof, and at least three sidewall panels 20 all attached to the bottom panel 26, thereby defining an internal cavity 43 with an access opening 45 (FIG. 6*b*). This triangular configuration can be particularly advantageous for placement of the holder 10 against a countertop corner, thereby, maximizing available countertop space.

Figure 6A:
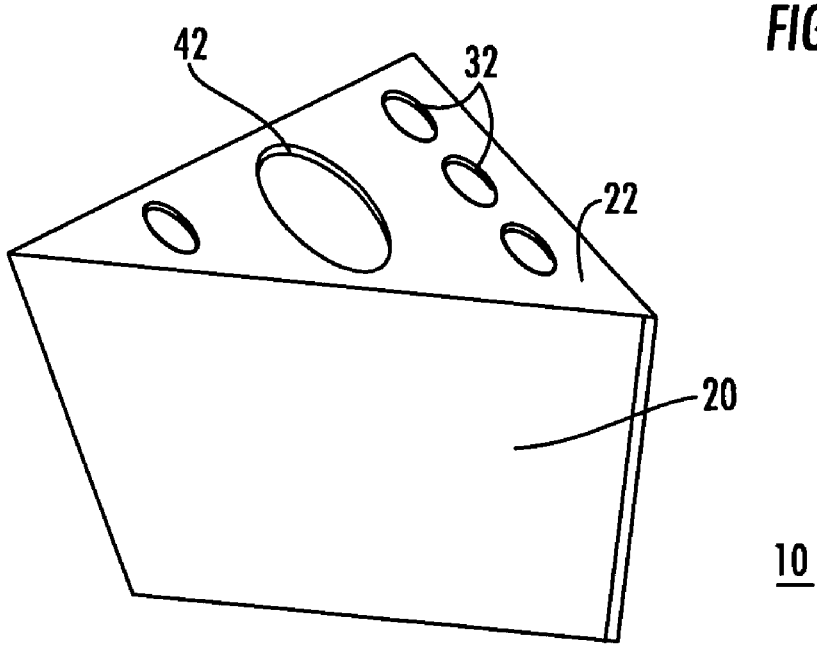
FIG. 6*a* is an upper perspective view of the holder shown in FIG. 5 with a triangular cross-section as seen along the horizontal, with the top panel depicted in a first position where access to the interior of the holder is precluded.

Like the previous embodiments, the top panel 22, sidewall panels 20 or both, in FIGS. 5-6*b* includes at least one toothbrush receiving opening 32, 34, 36, 38 adapted to support a correspondingly sized toothbrush (not shown) therein, and at least one toothpaste tube receiving opening 42 to support a correspondingly sized toothpaste tube (not shown). However, in this embodiment as shown in FIGS. 6*a*-*b*, at least one of said sidewall panels 20 in the holder 10 is slidingly attached to both the top panel 22 and the bottom panel 26, in order to provide access to the internal cavity. 43. The width of the sidewall panel 20 is slidingly received within a correspondingly sized channel, or groove, 62 formed within the top and bottom panel 22, 26 such that the sidewall panel 20 can be translated within the channel 62 by the user between a first position (FIG. 6*a*), where the sidewall panel 20 substantially covers the upper access opening 45 and a second position (FIG. 6*b*) wherein the sidewall panel 20 provides at least partial access to the interior cavity 43 of the holder body 12 for improved cleaning capability.

Conversely, the outer periphery of the sidewall panel can include a channel (not shown) constructed and arranged to receive a projection (not shown) integrally connected to the top and bottom panel wherein the sidewall panel is readily translated between the first position and the second position along the projection.

Preferably, the holder body 12 of all the aforementioned embodiments shown in FIGS. 1-6*a* is hollow and can include at least one drain port 44 provided in the bottom panel 26 to allow any fluid therein to be emptied out of the interior of the holder, see FIGS. 2 and 5.

As show in FIGS. 1 and 5, all of the aforementioned embodiments can include an elevation means. The elevation means can comprise multiple discrete elevation projections, or foot structures, 64 provided proximate the bottom, peripheral edge of panel 26 such that fluid can empty through the drain port 44.

Alternatively, the elevation means can include a single, continuous elevation projection, or rim, 74 illustrated in phantom and provided along the outer surface of the bottom panel 26 periphery so that fluid can empty through at least one drain port 44. The single peripheral elevation projection 74 is preferred, because it raises the bottom panel 26 from a support surface (i.e. countertop) to permit draining of fluid through drain port 44 and yet contains the fluid beneath the holder body 12 and not all over the support surface.

Figure 7:
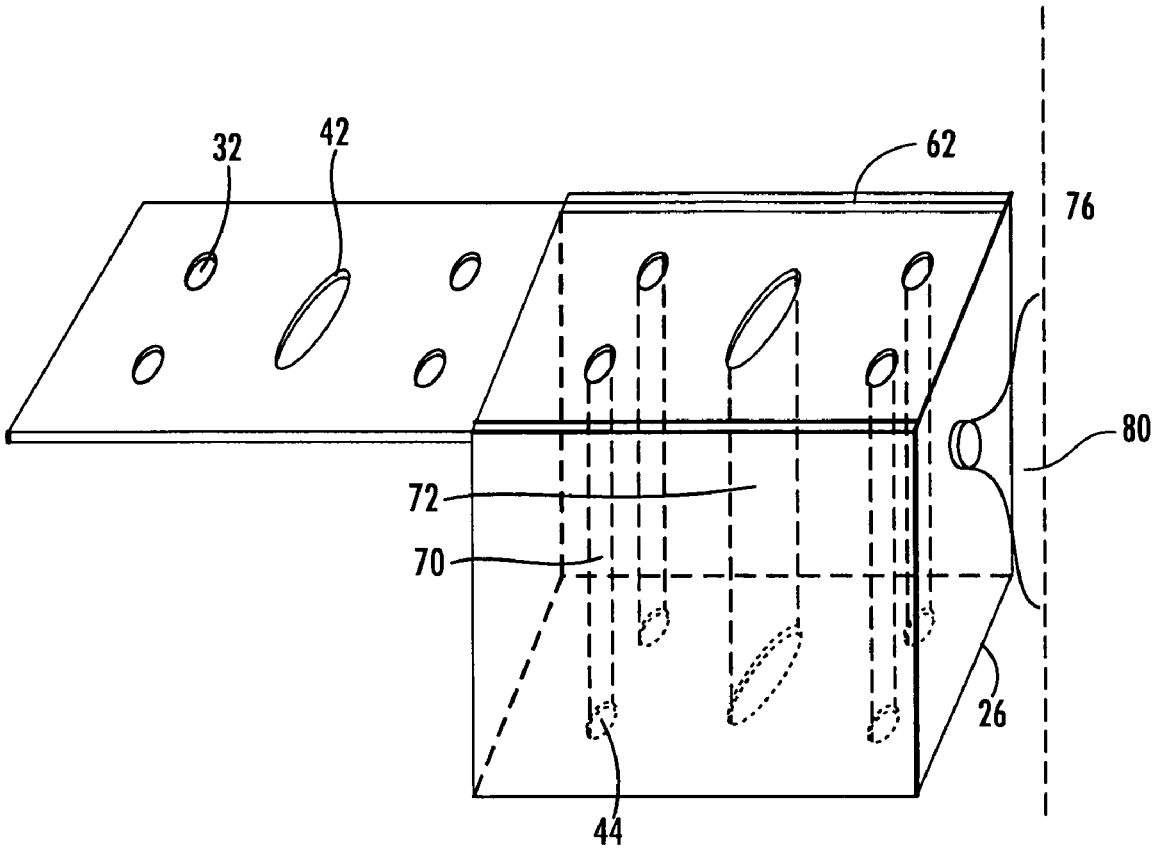
FIG. 7 is an upper perspective view of another embodiment illustrating a solid holder having a rectangular cross-section as seen along the horizontal axis comprising a plurality of toothbrush receiving ports and toothpaste tube receiving port opening into individual upright passageways that extend downwardly entirely through the solid holder body into corresponding passageway drain ports in the bottom panel.

Furthermore as shown in FIG. 7, it is contemplated herein that the holder body 12 can be formed of a solid material, wherein the toothbrush receiving ports 32 and toothpaste tube receiving port 42 open into individual upright passageways 70, 72, respectively. These passages extend through the holder body 12 and open into corresponding passageway drain ports 44 formed in the bottom panel 26. Like the aforementioned embodiments, the top panel 22 could be slidingly received within at least two of the sidewall panels 20.

It is contemplated that any of the above-mentioned forms of the instant holder 10 can be provided in virtually any desired material (e.g. plastics, metal, fiberglass, resin, porcelain, ceramics, or combinations thereof), color, and texture known to those skilled in the art. Moreover, the material may be translucent, transparent or opaque.

In any of the various embodiments discussed above, the instant holder can include at least one integrally formed means for removably attaching to a vertical surface 76, such as a bathroom wall, as shown in FIG. 7. For example, the means for attaching can include at least one, albeit not limited to, a suction cup 80, a hook, double-sided adhesive or the like, well known to those having ordinary skill in the art. In embodiments wherein the holder is supported above a horizontal surface, as in FIG. 7, the toothbrush receiving ports and/or and toothpaste tube receiving port could be tapered along the longitudinal axis or sized such that they retain the toothbrush and toothpaste therein. For example, the toothbrush receiving port can be smaller than the bristle end of a standard toothbrush, such that the toothbrushes are supported by their bristle portions abutting the upper surface of the top panel 22 when in the first and/or second position.

It is further contemplated that any of the above-mentioned forms of the instant holder can be used to store smaller dentifrice related items (e.g. toothpicks, dental floss, etc.,) therein which is particularly beneficial when traveling.

It is to be understood that while certain forms of the invention are illustrated, the scope of the invention is not to be limited to the specific forms or arrangements herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The various apparatus, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A holder for supporting various dentifrice items therein comprising in combination:

a body defined by a top panel, a bottom panel in spaced apart relation along a longitudinal axis thereof, at least two pairs of two opposing sidewall panels, each of said sidewall panels attached to said bottom panel, thereby defining an internal cavity with an upper access opening;

said body includes at least one toothbrush receiving opening adapted to support a correspondingly sized toothbrush therein and at least one toothpaste tube receiving opening adapted to support a correspondingly sized toothpaste tube;

said top panel is slidingly attached to one pair of opposing sidewalls for movement between;

i) a first position at which said top panel substantially covers said upper access opening; and ii) a second position at which said top panel provides at least partial access to said interior cavity of said holder so that additional items may be placed in said interior cavity;

wherein said top panel is capable of supporting said at least one toothbrush in said corresponding port and said at least one toothpaste tube in said corresponding toothpaste tube port when said top panel is in both said first and said second position.

2. The holder as set forth in claim 1, wherein the upper periphery of at least one pair of opposing sidewalls includes a channel constructed and arranged to receive the width of said top panel, whereby said top panel is readily translated by the user between said first position and said second position along said at least one pair of opposing sidewall channels.

3. The holder as set forth in claim 1, wherein the outer periphery of said top panel includes a channel constructed and arranged to receive a projection integrally connected to at least one pair of opposing sidewalls, whereby said top panel is readily translated by the user between said first position and said second position along said at least one pair of opposing sidewall projections.

4. The holder as set forth in claim 1, wherein at least one said toothpaste tube receiving port is formed in said top panel, wherein said toothpaste tube receiving port is constructed and arranged to support said toothpaste tube when said top panel is in said first position or said second position.

5. The holder as set forth in claim 1, wherein said at least one toothbrush receiving port includes a chamfered edge adapted to retain said toothbrush in a position generally parallel to said longitudinal axis.

6. The holder as set forth in claim 1, wherein said holder further comprises at least one drain port in said bottom panel.

7. The holder as set forth in claim 6, further comprising at least one elevation projection extending from said body generally parallel to said longitudinal axis thereof, for elevating said body above a horizontal surface.

8. The holder as set forth in claim 7, wherein said elevation projection comprises a continuous peripheral elevation projection for retaining any fluid emptying from said at least one drain port underneath said bottom panel.

9. The holder as set forth in claim 1, wherein said internal cavity is filled with a solid material and said toothbrush receiving ports and said toothpaste tube receiving port open into individual upright passageways formed within said solid material and extend generally parallel to said longitudinal axis of said body.

10. The holder as set forth in claim 1, wherein said holder body is formed from at least one of the group consisting of plastic, metal, resin, fiberglass, porcelain, ceramic.

11. The holder as set forth in claim 1, wherein at least one said sidewall includes at least one means for removable attachment to a vertical surface.

12. A holder for supporting various dentifrice items therein comprising in combination:

a body defined by a top panel, a bottom panel in spaced apart relation along a longitudinal axis thereof, at least three sidewall panels attached to said bottom panel, thereby defining an internal cavity with an access opening;

said top panel includes at least one toothbrush receiving opening adapted to support a correspondingly sized toothbrush therein and at least one toothpaste tube receiving opening adapted to support a correspondingly sized toothpaste tube;

wherein at least one of said sidewall panels is slidingly attached to said top panel and said bottom panel for movement between;

i) a first position whereby at least one said sidewall panel substantially covers said access opening; and ii) a second position whereby said sidewall panel provides at least partial access to said interior cavity of said holder, so as to provide improved access to said interior cavity for easy cleaning.

13. The holder as set forth in claim 12, wherein the upper periphery of said top panel and said bottom panel each include a channel constructed and arranged to receive the width of said sidewall panel, wherein said sidewall panel is readily translated between said first position and said second position along said top panel channel and said bottom panel channel.

14. The holder as set forth in claim 12, wherein the outer periphery of at least one sidewall panel includes a channel constructed and arranged to receive a projection integrally connected to both said top panel and said bottom panel, wherein said sidewall panel is readily translated between said first position and said second position along said top panel projection and said bottom panel projection.

15. The holder as set forth in claim 12, wherein said at least one toothbrush receiving port includes a chamfered edge adapted to retain said toothbrush in a position generally parallel to said longitudinal axis.

16. The holder as set forth in claim 12, wherein bottom panel further comprises at least one drain port in said bottom wall.

17. The holder as set forth in claim 12, further comprising at least one elevation projection extending along said longitudinal axis from said body for elevating said body above a horizontal surface.

18. The holder as set forth in claim 17, wherein said elevation projection comprises a continuous peripheral elevation projection for retaining any fluid emptying from said at least one drain port underneath said holder body.

19. The holder as set forth in claim 12, wherein said holder body is formed from at least one of the group consisting of plastic, metal, fiberglass, ceramic, porcelain.

* * * * *